US012256792B2

(12) United States Patent
Thacher et al.

(10) Patent No.: US 12,256,792 B2
(45) Date of Patent: Mar. 25, 2025

(54) TRANSPARENT AND MULTI-FACETED FACE MASK

(71) Applicant: DISNEY ENTERPRISES, INC., Burbank, CA (US)

(72) Inventors: Sara Larissa Thacher, Pasadena, CA (US); Leslie Margaret Evans, La Crescenta, CA (US); Jeremie A. Papon, Los Angeles, CA (US); Loyal J. Pyczynski, Valencia, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 1024 days.

(21) Appl. No.: 16/926,305

(22) Filed: Jul. 10, 2020

(65) Prior Publication Data

US 2022/0007755 A1 Jan. 13, 2022

(51) Int. Cl.
*A41D 13/11* (2006.01)

(52) U.S. Cl.
CPC ..... *A41D 13/113* (2013.01); *A41D 13/1161* (2013.01)

(58) Field of Classification Search
CPC ..... A41D 13/113; A41D 13/1161; A41D 13/1107; A41D 13/1146; A41D 13/1123; A41D 13/1138; A41D 13/1115; A41D 13/11–1192; A62B 23/00–025;
(Continued)

(56) References Cited

U.S. PATENT DOCUMENTS 4,417,575 A * 11/1983 Hilton ..... A41D 13/1123 128/206.16
4,419,994 A * 12/1983 Hilton ..... A41D 13/1123 128/206.16
9,770,058 B2 * 9/2017 Angadjivand ..... D04H 3/16
(Continued)

FOREIGN PATENT DOCUMENTS

CN 109152433 A * 1/2019 ..... A41D 13/113
WO WO-2018140841 A1 * 8/2018 ..... A41D 13/11
WO WO-2018235698 A1 * 12/2018 ..... A41D 13/11

OTHER PUBLICATIONS

Definition and synonyms for "Overlap" (Year: 2024) Access from website of https://www.wordhippo.com/what-is/another-word-for/overlap.html#C0-3).*

*Primary Examiner* — Rachel T Sippel
*Assistant Examiner* — Gwynneth L Howell
(74) *Attorney, Agent, or Firm* — Dorsey & Whitney LLP

(57) ABSTRACT

A transparent face mask for enhancing communications while controlling release of respiratory droplets. The mask includes a body formed from a thin flexible plastic material such as polypropylene. The mask body has a center diamond shaped segment that cantilevers the mask body from the bridge of a wearer's nose. The body includes right and left side segments, which each extend outward from one of the four sides of a diamond-shaped center segment to form a segment-to-segment joint between adjacent side segment pairs that flexibly conforms the side portions to the wearer's face. The face mask includes risers formed of an elongate strip of flexible material with a cloth covering for comfort
(Continued)

and ease of fit, and the risers each provides a contact point between the mask and the wearer's face adjacent to and inward of the ear from which the mask body is cantilevered away from the wearer's face.

26 Claims, 5 Drawing Sheets

(58) Field of Classification Search
CPC ..... A62B 18/00; A62B 18/02–025; A62B 18/088; A62B 3/00; A62B 90/05
See application file for complete search history.

(56) References Cited

U.S. PATENT DOCUMENTS

| | | | | |
|---|---|---|---|---|
| 2006/0230485 | A1* | 10/2006 | Lee | A41D 13/1138 2/15 |
| 2010/0051032 | A1* | 3/2010 | Kim | A41D 13/1115 128/206.19 |
| 2012/0285474 | A1* | 11/2012 | Healy | A41D 13/1138 128/863 |
| 2016/0235136 | A1* | 8/2016 | Palomo | A41D 31/12 |
| 2019/0069615 | A1* | 3/2019 | Lam | A41D 13/1161 |
| 2021/0370107 | A1* | 12/2021 | Lee | A41D 13/1115 |

* cited by examiner

TRANSPARENT AND MULTI-FACETED FACE MASK

BACKGROUND

1. Field of the Description

The present invention relates, in general, to face coverings designed and used to limit the spread of respiratory pathogens, and, more particularly, to a new face mask designed to be non-restrictive to the user, to be lightweight and comfortable for extended wear, and to provide a desired flow of air in to the wearer's nose and mouth and a desired flow of breath out of the mask.

2. Relevant Background

There are many environments in which it is desirable for people to wear face coverings when in public settings. Recently, there has been great concern with the spread of respiratory pathogens, and, as result, it is more common that people wear a face covering such as a face shield, which covers the entire wearer's face, or a face mask, which covers the wearer's face at least from the nose to the chin or below the chin. Face coverings help prevent or at least limit the spray of respiratory droplets from the wearer's nose and mouth.

While face masks and shields have been used for many decades, the designs were often uncomfortable for long term, outdoor, and active uses. However, there have been more recent demands for face coverings that can be worn for many hours, such as for a worker during their entire work shift, and in all environments including outdoors where it may be hot and humid or where users are active such as walking, running, cycling, and so on. As a result, there remains a need for face coverings that are less restrictive for the wearer in that they do not inhibit vision or normal breathing patterns. Further, it is desirable for face coverings be provided that are more comfortable to wear. Additionally, the masks should facilitate verbal and non-verbal communications, which often are difficult with existing masks as the wearer's voice is muffled and listeners cannot see the wearer's or speaker's mouth or see facial expressions.

Face shields are typically supported by a headband and have a clear plastic arcuately-shaped shield that is spaced away from the user's skin. These provide some improvements over common cloth face coverings in comfort and communications, but face shields are heavy to wear and are typically relatively expensive so that many in the population will not purchase a face shield. Additionally, even though these shield are made of clear materials, their size and weight make them more obtrusive and distracting to the wearer and the observer than face masks. Often, the large shield also restricts the wearer's motions more than a simple cloth face mask, so they are often not suitable for activities like walking, running, bicycling, and the like. Further, face shields make it difficult for the wearer to accessorize with glasses, headbands, hats, and many other accessories, which makes them less attractive to the general public for extended wear situations and in many outdoor applications (e.g., a person trying to protect their head from the Sun with a hat will not also want to wear a face shield) and for extended wear environments.

In general, face masks are fabricated from cloth and other opaque materials. Most technology around face masks has related to their performance as filters to allow air to pass through the mask's body or material while also blocking fluids, particulates, and germs from flowing in either direction. As a result, most innovations have been directed to filtering material, improved airflow through the mask's body or material, and containment (e.g., improved mask-to-skin interfaces or sealing/contact surfaces). Hence, these face masks tend to be uncomfortable to wear, can be distracting to the wearer, and are often unpleasant to wear in social settings where face-to-face communications are expected. Existing face masks often restrict facial movements. Moreover, most face masks create barriers to human interaction because they muffle and reflect sound so that listeners cannot hear as well and the speaker also hears an echo or other distortions in their speech. Further, existing face masks undesirably prevent visual connection to the wearer's smiles, laughter, facial expressions, and lip movement during speech.

SUMMARY

The present invention addresses the above problems by providing a multi-faceted, transparent, and lightweight face mask. The inventors developed a face mask that can be worn with improved comfort when compared with most cloth face masks and typical face shields. Further, the face mask with its transparent body and other features provides enhanced communication for the wearer because they can share their facial expressions and movement of their mouth as observers can see all or most of their face through the body of the face mask. At the same time, though, the new face mask limits the spray of respiratory droplets from the wearer so as to achieve the personal protective goals that can enable people to interact in public gatherings.

In brief, the face mask (which may also be labeled as a face covering or partial face shield) includes a body formed from a thin flexible plastic material such as may be cut from a flat sheet stock. The body of the mask has a shape and configuration that allows for overlapping areas between the side segments (which each extend outward from a diamond-shaped center or middle segment) that make use of a pressure fit, rather than requiring adhesive or the like that may cause undesired stiffness, to form a segment-to-segment joint that flexibly conforms the side portions of the mask body to the wearer's face. The face mask may include ear risers formed of an elongate strip of flexible material with a cloth or other material covering for comfort and ease of fit, and the ear risers each function to provide a contact point between the mask and the wearer's face adjacent to and inward (toward the nose) of the ear from which the body of the mask is cantilevered away from the wearer's face to limit skin-to-mask contact.

The face mask includes a band or bands flexibly attached to the end of the ear risers, and the band or bands are attached to the wearer's head. Note, these may be replaced with ear hooks in some embodiments or with a clip(s) for attaching the mask body to a wearer's hat, glasses, or hair. Folds or seams in the body between segments of the body are provided to increase the strength of the dimensional form of the body while decreasing overall weight and keeping an unobstructed (e.g., by a seam formed with an adhesive or other joint) view of the wearer's mouth and/or face. Further, folds along the edges of the body may be included to increase the rigidity of the material of the body during wear. The pattern or design of the body of the mask may include use of elongate tabs on an outer edge of the two top side segments that fit into slots on an outer edge of the two bottom side segments (or vice versa) for quick dimensional assembly and ease of manufacture of the new face mask.

More particularly, a face mask is provided that is designed for user comfort even with extended use and for enhancing communications while controlling respiratory droplets. The face mask includes a body with an upper edge and a lower edge, and the body is formed of a flexible material (such as a flexible plastic (e.g., from stock or sheets of clear polypropylene (PP), clear polyphenylene ether (PPE), or clear polyethylene terephthalate (PET) with a thickness in the range of 0.010 to 0.030 inches or the like). The body includes a center segment extending from the upper edge to the lower edge, which is adapted to direct breath downward and to provide a device for cantilevering the mask off the bridge of the wearer's nose. The body further includes an upper left segment, a lower left segment, an upper right segment, and a lower right segment connected to sides of the center segment, and the upper left and the lower left segments extend outward to a left edge of the body at an angle and the upper right and lower right segments extend outward to a right edge of the body at the angle. Further, the face mask includes a connection mechanism (e.g., a flexible band(s), ear hooks, and the like) coupled to the left and right edges of the body that is adapted to attach the body of the face mask to a person's head with the body positioned over the person's nose and mouth.

In some embodiments, an outer surface of the body including outer surfaces of the center segment, the upper left segment, the lower left segment, the upper right segment, and the lower right segment is multi-faceted. This can be achieved by configuring the sides of the center segment (which may be formed via scoring to define bend/fold lines) to form a diamond shape with an upper point at a center of the upper edge of the body and with a lower point at a center of the lower edge of the body. In such embodiments, wherein the angle can be in the range of 120 to 150 degrees. Further, to define a curved or vortex-forming flow path for exhaled breath of the wearer, the center segment can be nonplanar with a bend about a line extending between side points of the diamond-shaped segment, with the bend defining an angle in the range of 120 to 160 degrees. In this way, the interior surfaces of the body define an arcuate bowl for use in directing breath exhaled from the person's nose and mouth downward to pass through a gap between the lower edge of the body and the person's face or neck.

Further, in such diamond-shaped center segment implementations, a first seam can be formed between the upper left segment and the lower left segment and a second seam can be formed between the upper right segment and the lower right segment. Particularly, the first and second seams are preferably provided by an overlapping of material that is press fit together to limit airflow through the body. The mask further may include first and second risers attached to and extending along left and right outer edges of the body and outward a cantilever distance from the upper edge of the body to mate with the connection mechanism via outer ends of the first and second risers. The first and second risers have a rigidity and flexibility great enough to lever the left and right outer edges of the body away from the person's face to create airgaps between the body and person's face. In some cases, the first and second risers each includes a cloth edge trimming affixed to the body and an elongate plastic member (e.g., a planar strip of polystyrene or the like) received within the cloth edge trimming, with this plastic member providing the cantilevering or leveraging effect to retain spacing between the sides of the body of the face mask and the wearer's face.

At rest and in use, the upper and lower edges are arcuate in shape (e.g., U-shaped). This combined with the multi-segment configuration cause the body of the mask to be supported on the person's face at five contact points. These include a first contact point on the bridge of the wearer's nose, second and third contact points on an upper portion of the wearer's cheek, and fourth and fifth contact points on the wearer's face between the wearer's ears and the wearer's eyes. As a result, two spaces or gaps are created between the upper edge and the wearer's face between the second and third contact points and the wearer's nose. These spaces or gaps provide the main inlets for air to be taken into the wearer's nose and mouth during breathing.

DETAILED DESCRIPTION

Embodiments described herein are directed toward a new face mask designed to limit the spray of respiratory droplets, to be lightweight and comfortable to wear, and to be readily manufactured at relatively low material and assembly costs.

Figure 1:
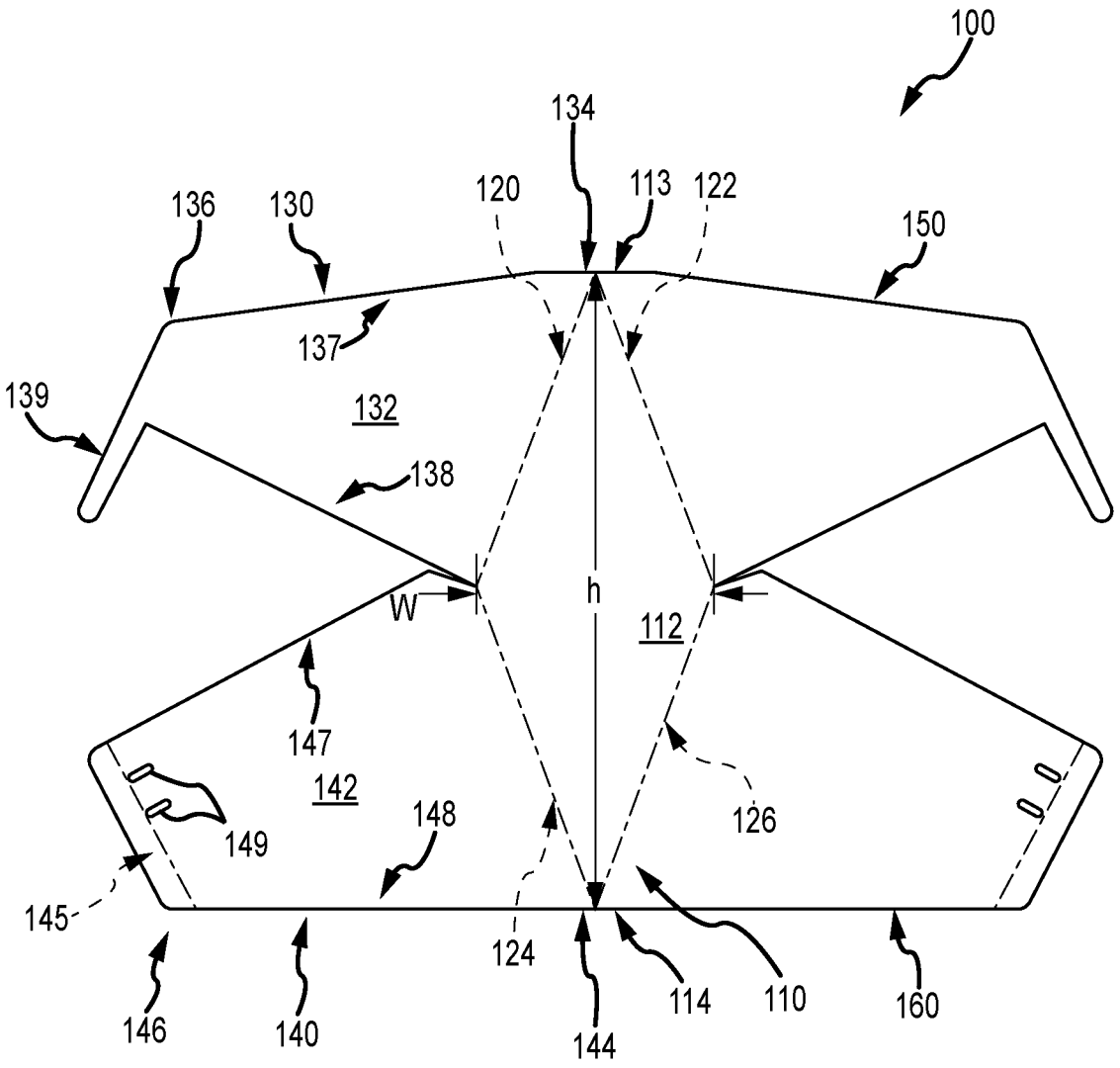
FIG. 1 is a plan view of a body of a face mask of the present description prior to folding and other assembly steps showing the five segments used to provide its multi-faceted surface.

FIG. 1 is a plan view of a body 100 of a face mask of the present description (shown with assembled face mask 200 in FIG. 2) prior to folding and other assembly steps have been completed. As shown, the body 100 is formed to have five segments 110, 130, 140, 150, and 160 to facilitate easy assembly and to provide its multi-faceted surface that facilitates the fit of the mask to a wide variety of face sizes and shapes, assists in directing the flow of breath in a desired manner, and enhances the visibility of the wearer's face during use of a mask that includes the body 100.

To make reaching these design goals possible, the body 100 is formed (e.g., cut) from a flexible material such as paper stock, a translucent-to-opaque plastic, or a transparent plastic. Preferably, the plastic and its thickness (or weight) is chosen to allow the body 100 to be flexible enough to be bent and conform to some degree to a wearer's face but yet be strong enough to serve retain its shape upon assembly (e.g., to have some amount of spring to return to its assembled shape prior to being placed on a wearer's face and tied on) and also not to tear or break during use. Further, it was desired that the material used for the body 100 have "memory" in that seams or folds formed through bending (after scoring prior to such bending or folding) be remembered (e.g., some amount of non-elastic deformation occurs during assembly). The inventors performed significant experimentation and testing prior to determining that the body 100 can be formed from clear (or opaque in some cases) sheets or stock of polypropylene, polyphenylene ether (PPE), polyethylene terephthalate (PET or polyester), or the like that is thin to be as lightweight as practical while still meeting other design goals (such as strength, springiness, and so on), with thicknesses in the range of 0.010 to 0.030 inches (or 10 to 30 mils) being useful in some implementations of the body 100 and one preferred body 100 formed from clear polypropylene stock in the thickness range of 0.01 to 0.015 inches.

Also, through numerous tests of prototypes, the inventors determined that a multi-faceted body is desirable for assembly and for meeting the desired functions of a mask with the body, and it was determined through this process that a center or middle segment 110 should be provided from which the other four segments (or wings) 130, 140, 150, and 160 can be attached via folds or seams 120, 124, 122, and 126, respectively. Further, it was proven that a very useful shape for the center segment 110 is a diamond shape. Hence, as shown, the center segment 110 is configured to have a diamond-shaped front or outer side or surface 112 (as well as a like shaped back or inner surface on its opposite side), which is defined by a width, w, and a height, h, extending from a first or upper edge 113 of the body 100 to a second or lower edge 114 of the body 100.

The size of the diamond-shaped segment 110 may vary to practice the invention, with it being useful to have one, two, three, or more sizes of masks to suit the range of face sizes in a population, but it is common for the height, h, to fall in the range of 3 to 6 inches and the width, w, to be less than the height, h, and fall in the range of 1.5 to 4 inches. Stated differently, the body 100 may be sized to be small, medium, and large in some cases with an overall width of the flat body 100 shown in FIG. 1 being in the range of 9 to 12 inches (with one embodiment using 9.14 inches, 9.8 inches, and 11.07 inches for small, medium, and large) and an overall height of the flat body 100 being in the range of 5 to 7 inches (with one embodiment using 5.22 inches, 6.0 inches, and 6.75 inches for small, medium, and large).

The center segment 110 is further defined by its four sides provided by seams or folds 120, 122, 124, and 126. In FIG. 1, the body 100 is shown prior to the physical folding or bending of the plastic stock material but with scored fold lines at the locations of the seams/folds 120, 122, 124, and 126 defining the front or outer surface 112 of the center segment 110. The body 100 is symmetric in design relative to the center segment 110 with side segment 150 mirroring side segment 130 and side segment 160 mirroring side segment 140, and, with this in mind, the following description describes side segments 130 and 140 in more detail with it being understood this also describes segments 150 and 160.

As shown, the upper right (when worn) segment 130 has a first or inner side 134 extending outward from the seam 120 (or side of center segment 110) at a first width matching the length of the seam/side 120 toward a second or outer side 136. The outer (and opposite inner) surface 132 of the segment 130 is further defined in shape and size by a third or upper side 137 and a fourth or lower side 138, which both extend between the inner and outer sides 134 and 136. The lower side 138 is shown to extend outward in a linear or straight-line manner while the upper side 137 extends outward in a downward angled manner (e.g., at an angle of 30 to 60 degrees relative to line orthogonal to a longitudinal axis of the center segment 110, with 45 degrees used in some cases).

The upper side 137 may have two angled portions as shown such that the first or inner portion (e.g., with a length of 0.2 to 0.5 inches or the like) at or near inner side 134 is angled to a lesser degree (such as in the range of 30 to 45 degrees) while the second or outer portion at or near outer side 136 is angled to a greater degree (such as in the range of 45 to 60 degrees). This stepping provides a center portion of the upper edge 113 of the body at the upper tip/point of the diamond-shaped center segment 110 that can be closer to orthogonal where the body 100 mates with or abuts the bridge of a wearer's nose. Extending from the outer side 136 of the segment 130 is an arm 139 with a width of 0.2 to 0.4 inches (or the like) and a length of 0.5 to 1.0 inches or the like, which is used to couple the segment 130 with the segment 140 during bending and assembly of a mask with the body 100.

Also, as shown in FIG. 1, the lower right (when worn) segment 140 has a first or inner side 144 extending outward from the seam 124 (or side of center segment 110) at a first width matching the length of the seam/side 124 toward a second or outer side 146. The outer (and opposite inner) surface 142 of the segment 140 is further defined in shape and size by a third or upper side 147 and a fourth or lower side 148, which both extend between the inner and outer sides 144 and 146. The lower side 148 is shown to extend outward in a linear or straight-line manner while the upper side 147 extends outward in a downward angled manner, e.g., at an angle of 30 to 60 degrees with 45 degrees used in some cases.

The upper side 147 may have two angled portions as shown such that the first or inner portion (e.g., with a length of 0.2 to 0.5 inches or the like) at or near inner side 144 that is angled to upward to follow lower side 138 of the upper right segment 130 a short distance (such as an angle in the range of 30 to 45 degrees upward from a horizontal center line of the center segment 110 for a distance of 0.2 to 0.5 inches) while the second or outer portion at or near outer side 146 is angled to a greater degree (such as in the range of 30 to 45 degrees). To facilitate assembly, the outer side 146 of the segment 140 includes a pair of spaced apart slots 149 with a width a small amount greater than a width of arm 139, and the slots 149 are configured to receive the arm 139 during assembly of a mask with body 100. Further, a fold line 145 may be scored adjacent and outward of the slots 149 near the outer side 146 of the segment 140 to define where a portion of the segment 140 may be bent or folded back on itself (toward the center segment 110) to further enclose the arm 139 and to provide strengthening of an outer side/edge of a formed mask with body 100 by increasing (e.g., doubling) the amount of material provided at this portion of the formed mask.

In some planned embodiments, a filter, e.g., a cloth or other filter, may be provided in the body 100. This may be provided in the lower (below or near chin level) of the center segment 110 and/or lower side segments 140 and/or 160. This may be circular, rectangular, or other shaped and replace a portion of the flexible material (e.g., plastic) of the body 100 and may vary in size (such as 0.5 to 2 inches in diameter (or across a side)). The filter may be provided for air flow benefits such as to provide a filtered intake for breath and/or to provide an additional outlet for the breath (with particularly configured filtering).

Figure 2:
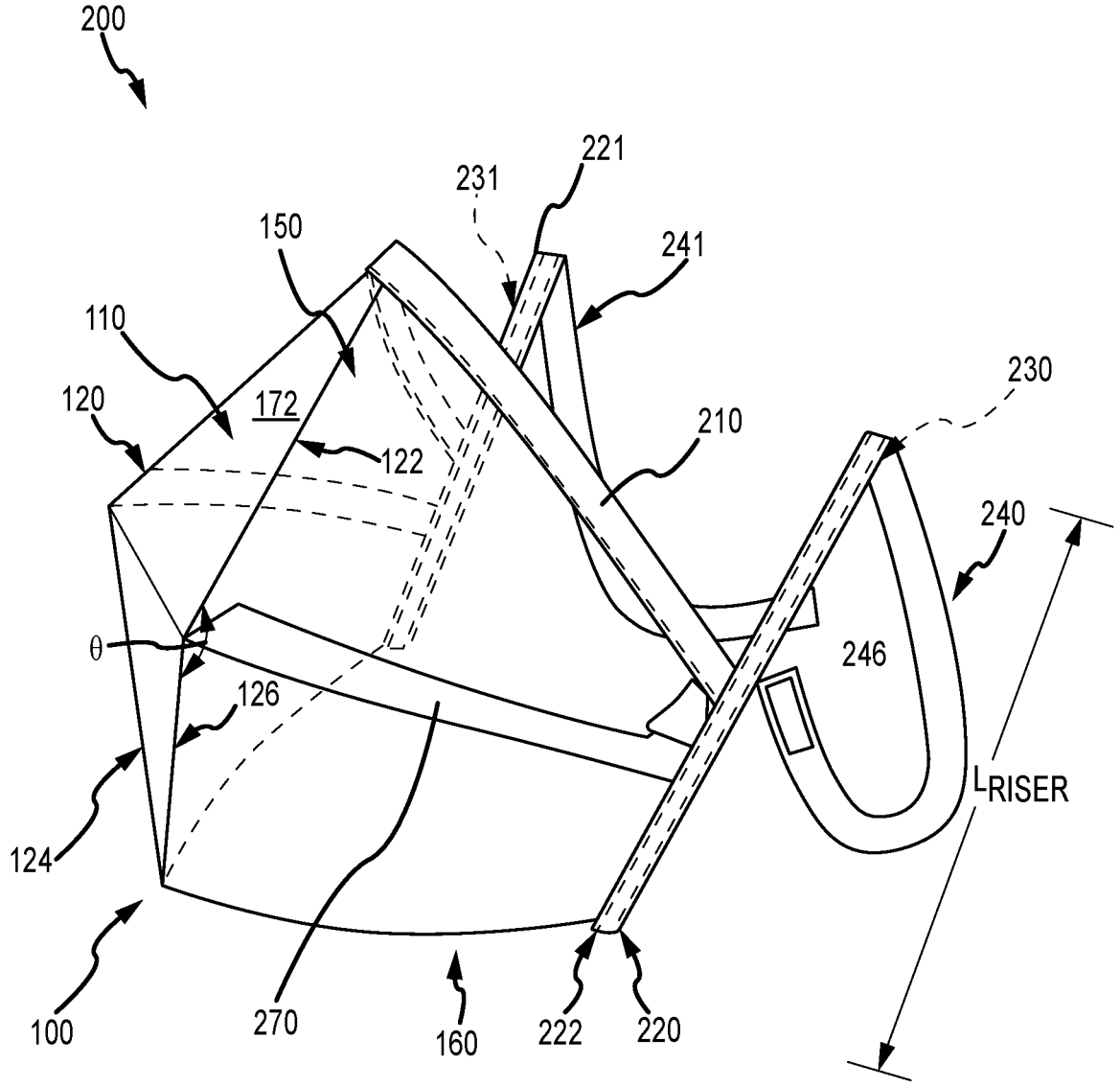
FIG. 2 is a left side perspective view of an assembled face mask including the body of FIG. 1.

FIG. 2 is a left side perspective view of an assembled face mask 200 including the body 100 of FIG. 1 after it has been folded/bent along seams or edges 120, 122, 124, and 126 of the center segment 110. The mask body 100 is folded from flat clear sheet material (e.g., 0.010 to 0.015-inch thick polypropylene, PPE, PET, or other clear plastic) to provide a generally polyhedral shaped "cup" with an open bottom. In other embodiments, though, this cup shape can be achieved using other manufacturing techniques such as vacuum formation or molding.

After the bending or other formation of the body 100 into the form shown in FIG. 2, the center segment 110 is deformed from being planar to having a bend along its longitudinal axis and generally about its horizontal axis (extending through opposite points where width, w, is measure). This bend is typically very gradual and defines an angle, θ, between the upper and lower halves/sections of the segment 110, with the angle being in the range of 120 to 160 degrees. During use, there is typically no or little additional bending from this at-rest state. The bending results in the inner surface of the segment 110 being curved inward to create a receiving surface at the outlet of a wearer's nose and mouth that was chosen by the inventors to create vortices in the wearer's output breath and/or otherwise direct breath flow cause it to being flowing toward the wearer (e.g., their neck and/or chest) rather than upward and outward.

The bend/curving of the segment 110 is also desirable to curve the lower portion of the mask 200 downward toward the wearer's chest so as to provide an unobstructed (or less obstructed) view. The folds/seams 120, 122, 124, and 126 in the body 100 defining the four sides of diamond-shaped center segment 110 and its outer surface 112 are also desirable because they increase the strength of the mask 200 and its ability to spring from a conforming shape back to the at-rest state shown in FIG. 2. The folds/seams 120, 122, 124, and 126 also decreases the overall weight needed for the mask 200 and provide an unobstructed view of the wearer's mouth. The side segments, as can be seen with right side segments 150 and 160 in FIG. 2, are, in the "at-rest" state prior to use, at an angle in the range of 120 to 150 degrees relative to the upper and lower planar portions of the center segment 110 due to the bending or folding about the seam/folds 120, 122, 124, and 126. During use, the mask body 100 will typically be folded inward some amount such that the at-rest angles between the side segments 130, 140, 150, and 160 and the diamond-shaped center segment 110 are reduced so that the mask 200 is flexed into a narrower configuration to fit each wearer's face (while still retaining spaces or airgaps as discussed below to limit skin-to-mask contact).

Further, the combination of the diamond shape of the center segment 110, along with the shapes of the side segments 130, 140, 150, and 160 (and further along with their attachment at seams 120, 122, 124, and 126 to the center segment 110), creates a joint 270 between the side segments 150 160 (and a like one would be formed between segments 130 and 140). Significantly, the joint 270 is formed with an overlapping of material (e.g., 0.1 to 0.25 inches or more) from the lower and upper sides of the side segments 150 and 160, and this joint is airtight or nearly so along its length during normal use (e.g., wearing) of the mask 200 due to a pressure fitting of the two segments 150 and 160 against each other rather than requiring adhesive or the like (which would detrimentally affect the transparency of the mask 200 in many cases). The two segments 150, 160 in mask 200 may be planar or arcuate (bow outward away from the face) and the joint 270 is formed in a manner that the body 100 flexibly conforms to a wearer's face during use of mask 200.

The upper edge 113 of the body 100 is covered with upper trim or edging element 210 that may be formed of soft skin-friendly material (e.g., a soft cloth body covering the inner and outer surface of the upper edge 113 affixed by stitching or the like). The upper trim or edging element 210 is formed to sit, when the mask 200 is worn, on the bridge or dorsum of the wearer's nose (e.g., like eyeglasses), which is used to support a portion of the weight of the mask 200. Both outer sides of the mask 200 (formed by an overlapping of the outer sides 136, 146 of the segments 130, 140, for example, along with arm 139 in slots 149 and overlapping portion at bend line 145) are also covered with a side trim or edging element 220, which may be formed of soft skin-friendly material similar or the same as element 210 and affixed to the body 100 via stitching as shown at 222.

In contrast to the upper trim element 210, the side trim element 220 (and element 221) serves additional functions to wearer comfort. Specifically, the side trim element 220 is formed to be open at an upper end and to form a channel for receiving an elongate stiffener or riser 230. The side trim element 220 and received stiffener/riser 230 extend from the lower edge/side 114 of the body 100 along its outer edge/side and then outward an additional length to provide a cantilevered section of a length of 1.5 to 3 inches or more. The riser/stiffener 230 is used to provide a contact point with a wearer's face near their ear or upper and outer cheek from which the riser/stiffener 230 can act to cantilever or leverage/lift the side segments 130, 140, 150, and 160 away from the wearer's face to limit plastic-to-skin contact during use of the mask 200.

To this end, the riser 230 (and riser 231) may be tubular or planar in cross-sectional shape (with an elongate planar member used in some embodiments) with a length to suit the size of the body 100 of the mask such as with a length, $L_{Riser}$, in the range of 3 to 6 inches (with a riser 230 of a small mask being 3.5 inches long, of a medium mask being 4.75 inches long, and of a large mask being 5.5 inches long in some implementations). The thickness (or diameter) may be in the range of 0.01 to 0.05 inches or more with a width (or diameter) in the range of 0.2 to 0.4 inches, and the body of the riser/stiffener 230 may be formed of a wide range of materials with a plastic (e.g., polystyrene, polypropylene, PPE, PET, or the like) being useful in many cases due to its weight and flexibility.

The ear risers or stiffeners 230, 231 and the encasing edge trim elements 220, 221 mate at an upper or outer end to bands 240, 241 (or to a single band in some cases), which can be tied together or coupled with Velcro or other coupling technologies to attach the mask to the wearer's head (e.g., by extending over their ears to a point behind their head). The bands 240, 241 may be replaced in some embodiments with ear hooks to attach the mask 200 to the wearer's ears or with clips or other components to attach the mask 200 to the wearer's hat, glasses, or hair. In some embodiments, the side trim 220, 221 and risers 230, 231 extend upward above the upper trim 210 (or top edge of the body 100) to terminate at the mounting points for bands/straps 240, 241, and the mounting points may be roughly aligned, when the mask 200 is worn, with the wearer's nose.

The mask 200 is flexible and can flex and deform to fit a variety of faces. However, it may be useful to provide dimensions of proposed small, medium, and large masks after assembly and when at rest (or prior to being placed on a wearer's head). The overall height, which coincides generally with the vertical height of the deformed diamond segment 110, is 4.5 inches for a small mask, 5.0 inches for a medium mask, and 5.5 inches for a large mask. The width of the mask 200 as measured from the outer sides of the lower segments 140 and 160 is 2.75 inches for a small mask, 3.25 inches for a medium mask, and 3.75 inches for a large mask. The depth of the mask 200 as measured from a lower point of the diamond-shaped segment 110 to a line extending between outer sides of the lower segments 140 and 160 is 4.25 inches for a small mask and 5.25 inches for a medium and large mask.

Figure 3:
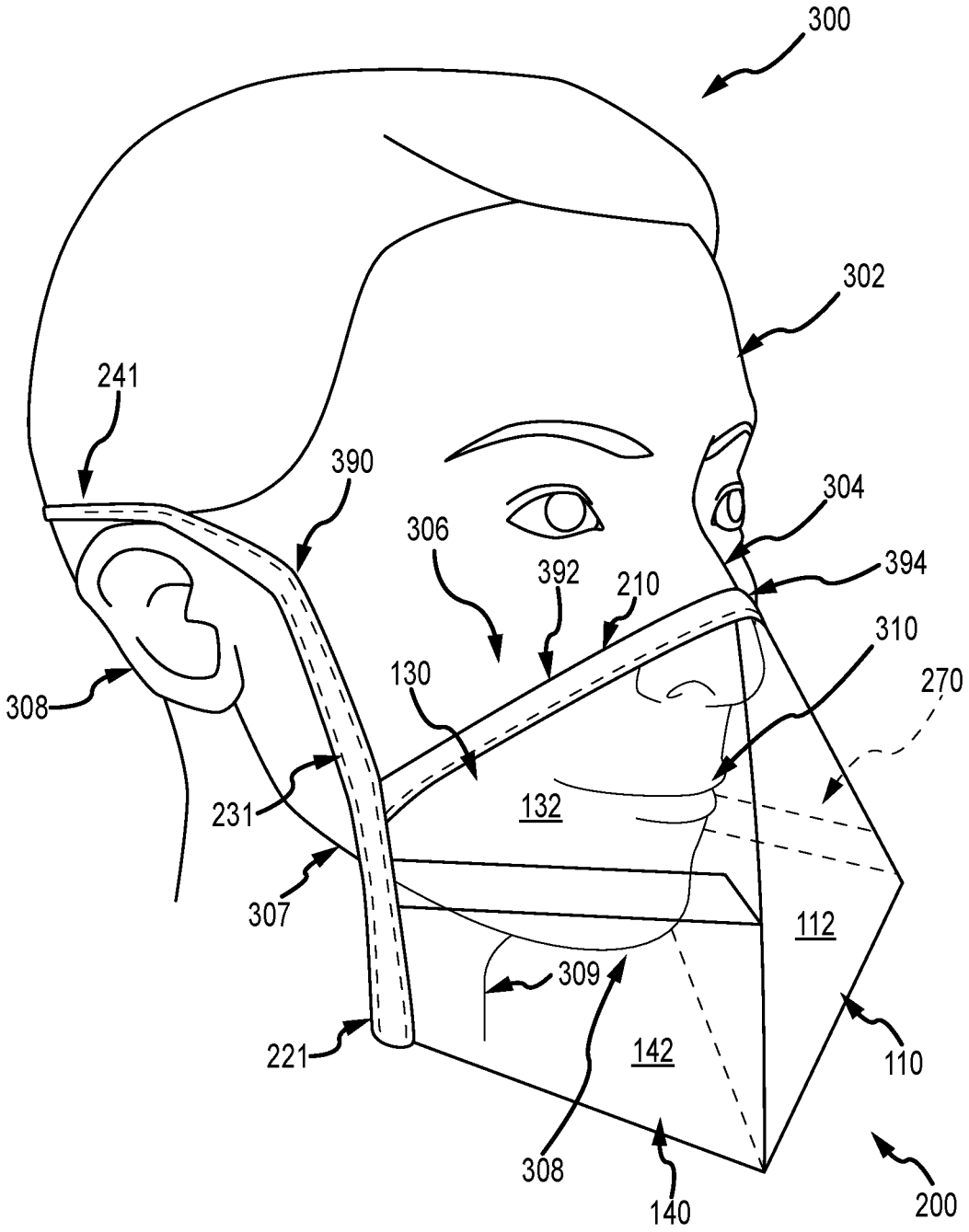
FIG. 3 illustrates the assembled face mask of FIG. 2 during use or while being worn on a person's face.

FIG. 3 illustrates this configuration with the mask 200 being worn by a user or wearer 300 to cover the lower portion of their face 302 and with the ear band 241 extending over the wearer's ear 308 to a point behind their head. The effect is that a behind the head strap 241 functions to both hold the mask 200 on the face 302 but also to pivot the mask 200 about the user's nose 304 so as to urge the lower portion of the mask body (e.g., the portion near and below the mouth 310) outward so as to not be in contact with the wearer's face to limit plastic-to-skin contact. This improves position control of the mask 200 on the face 302 of wearer 300 even when the mask 200 is worn in active situations. As shown, the mask body 100 is spaced apart from the wearer's face 302 at the mouth 310, chin 308, and much or all of their lower cheek 307.

For comfort and proper air flow patterns, the design of the mask 200 results in only five contact points or areas between the mask 200 and its materials and the wearer's face 302. Each riser provides a contact point at its upper or outer end where the side trim mates with the band, ear hook, or the like. This can be seen in FIG. 3 at 390 where the upper or outer end of the riser/stiffener 231 in the side trim/edging element 221 abuts the face 302 on an upper portion of their cheek 306 near their ear and temple (e.g., about midway between their ear and eye). The riser 231 acts to leverage or lift the body 100 of the mask 200 off of or away from the rest of the cheek 306 along the outer side of segments 130 and 140. Reference number 392 shows a location of another contact point between the mask 200 (i.e., a portion of the upper edge/side 113 of the mask body 100 covered by upper trim/edging 210) and the face 302 (e.g., a mid to upper portion of the cheek 306 at a distance from the nose 304 (such as 0.5 to 1.5 inches from a nostril or the like)). The final contact point, as shown at 394, is between the mask 200 (i.e., another portion of the upper edge/side 113 of the mask body 100 covered by upper trim/edging 210) and the bridge of the wearer's nose 304. The center segment 110 is rigid enough such that it is cantilevered off of the nose 304 while gravity acts to pull the lower portions of the body 100 of the mask 200 toward the wearer's chin 308 so to avoid or limit obstructing the wearer's downward vision (e.g., looks down and does not see or only sees a small portion of the transparent mask body 100).

From a communications standpoint, the mouth 310 and nose 304 of the wearer 300 are visible through the body 100 of the mask 200. The lower part of the face 302 (including the mouth 310 and cheeks 306 are visible in way that they are seen by an observer with the other uncovered portions as a whole and from all angles. This allows unprecedented non-verbal communication with smiles, lip movement, and complex face expressions while the face 302 is covered with the mask 200. The interior surfaces of the body 100 of the mask 200 are spaced apart from the mouth 310 which is not the case with cloth face masks and are shaped (with the multi-facets of segments 110, 130, 140, 150, and 160) to lessen both sound muffling (which affects how listeners perceive speech and is a problem with cloth face coverings and shields) and sound reflection (which affects how the speaker (and sometimes the listener) perceive their own speech and is a problem with face shields) so as to improve audible communications.

Figure 4:
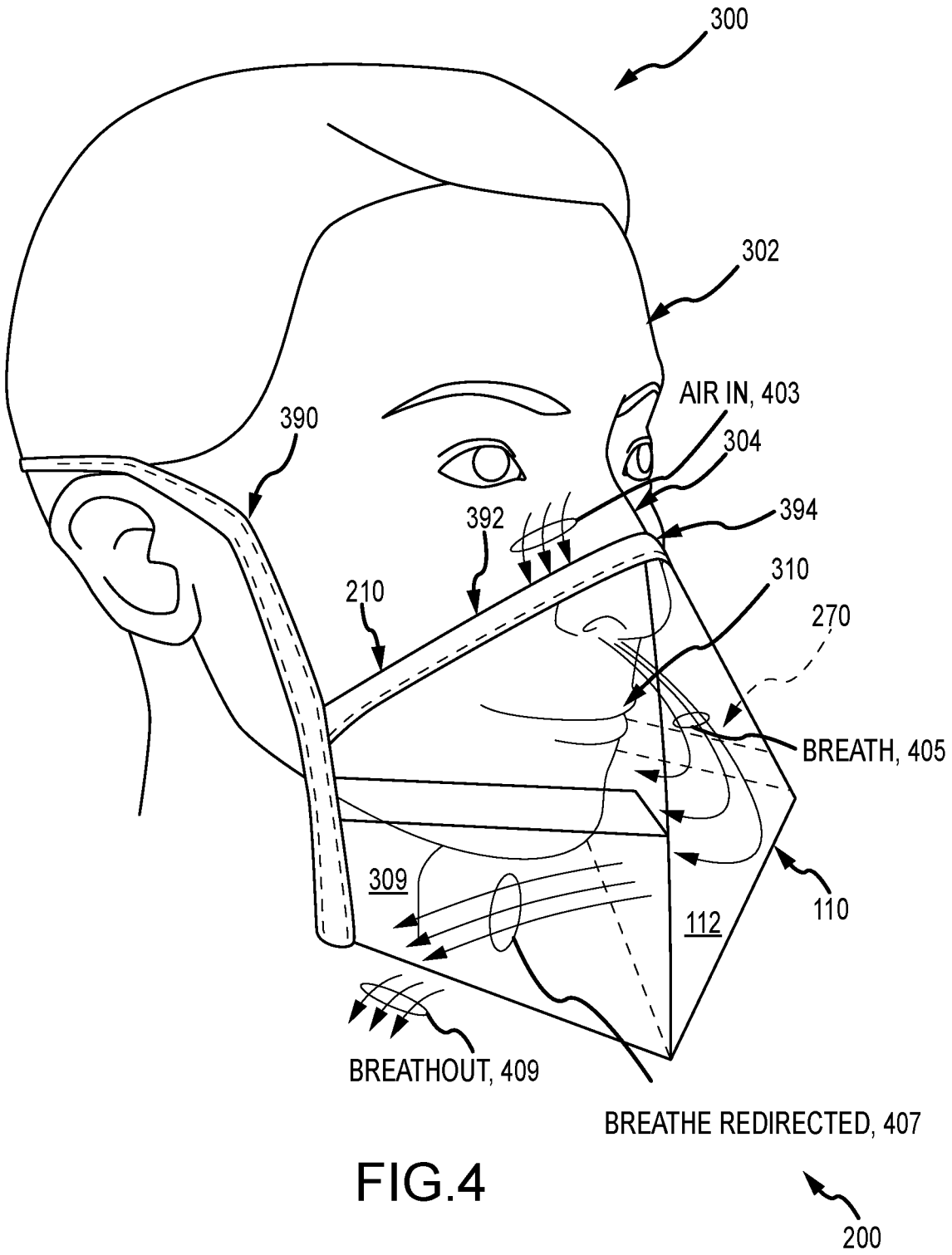
FIG. 4 illustrates the face mask and user or wearer of FIG. 3 showing air flow achieved with the new mask design.

FIG. 4 illustrates the face mask 200 and user or wearer 300 of FIG. 3 showing air flow achieved with the new mask design. Testing has shown that during use (while being worn by user 300, for example) that the main path for intake air to the wearer is along the path shown by arrows 403. This space is between the upper edge 113 of the mask body 100 (and encasing upper trim 210) and the face 302 at a location between the user's nose 304 and the contact point 392 on the upper cheek 306 of the wearer 300. This air 403 can be taken in by the wearer 300 through their nose 304 or mouth 310.

When the user exhales, their breath 405 is directed out and down from the face 302 such that it contacts the interior surfaces/facets of the body 100 of the mask 200 including the inwardly curved center diamond-shaped segment 110. This causes the breath 405 to be curled inward and downward in mini vortices and be redirected down as shown with arrows 407 until it exits the interior space of the mask 200 as shown with arrows 409 where it, in large part, strikes the wearer's neck 309 (near or below their Adam's apple) or upper chest. The breath 409 does not, however, flow upward past edge 113 and upper trim 210 or through the joint 270 between side segments 150, 160 (or a similar joint between segments 130, 140) even though these are only pressure fit together. In this way, all or the majority of an respiratory droplets in the breath 405 are captured on surfaces of the mask 200, on the wearer's skin, or on the wearer's clothing (e.g., the upper portion of their shirt (not shown)_.

As can be seen in FIG. 4, the cup of the assembled mask body 100 formed with segments 110, 130, 140, 150, and 160 extends from to a point just below the user's mouth 310 and neck 309 to direct exhaled air 405. From a protection standpoint, the focus of the design of the mask 200 is on redirecting rather than filtering expelled air 405 including that from sneezing, coughing, and normal breathing by the wearer 300. Air is directed downward rather than outward by the mask 200. Air and droplets avoid, in most cases, from being depositing on the user's face (as may occur with cloth coverings) and, instead, are directed to the ground.

Figure 5B:
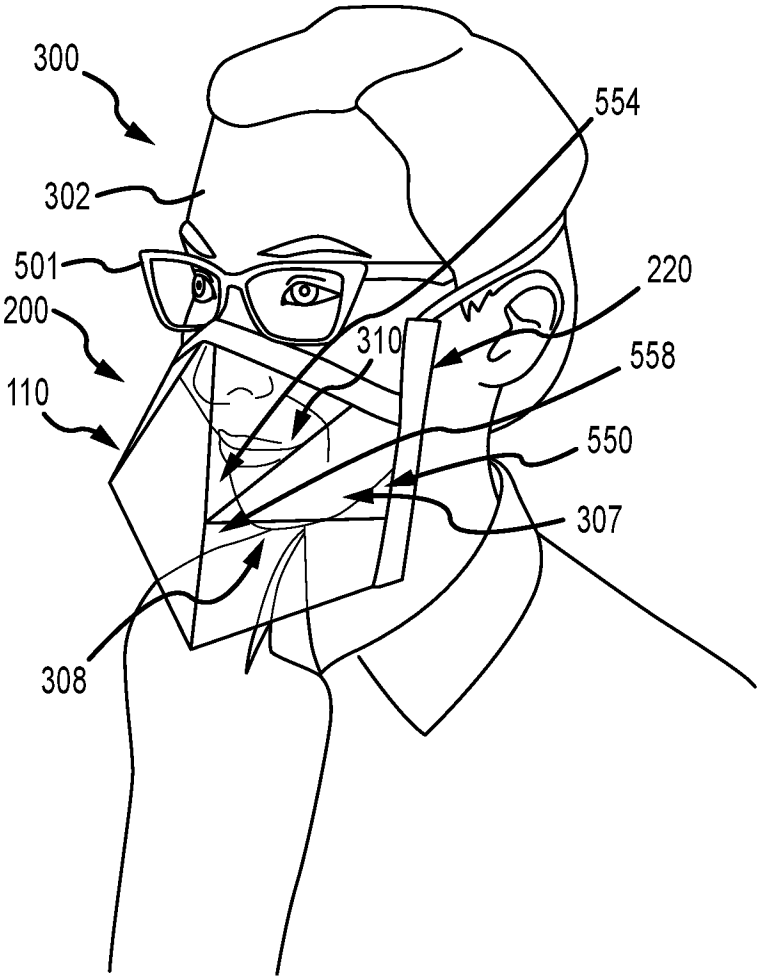
FIGS. 5A and 5B illustrate front and side views, respectively, of the face mask of FIG. 3 during its use by a user/wearer illustrating spaces or gaps achieved between the wearer's face and the body of the mask.
Figure 5A:
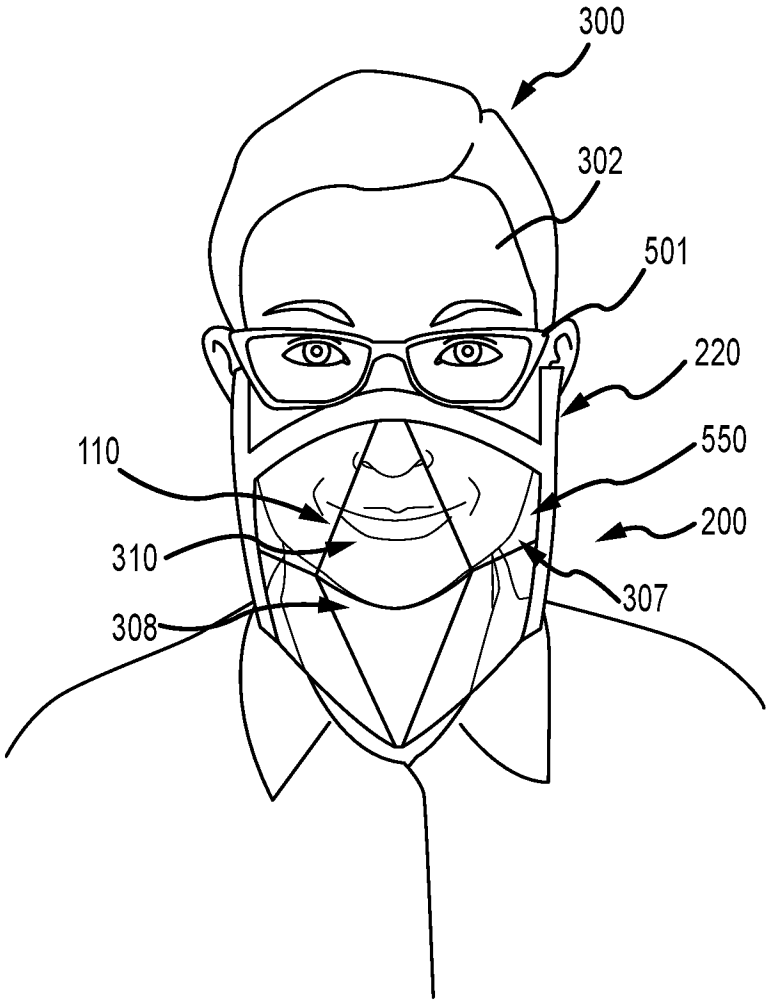

FIGS. 5A and 5B illustrate front and side views, respectively, of the face mask 200 of FIG. 3 during its use by a user/wearer 300 illustrating spaces or gaps achieved between the wearer's face 302 and the body 100 of the mask 200. As can be seen, the cantilevering provided by the ear risers/stiffeners in side trim/edging 220, for example, lifts the mask body 100 away from the lower sides of the wearer's face 302 (e.g., away from the lower cheek 307 along their upper jawbone) to form a space or airgap 550. Hence, the body 100 of the mask 200 is not pressed against the face 302, which could cause discomfort especially in hot environments or when the wearer 300 is active. The directing of air out the bottom as shown in FIG. 4 is useful for wearer's who wear eyewear 501 as hot air is not expelled upward so the eyewear lenses are less likely to fog (as is common with cloth face masks). Further, the center segment 110 is cantilevered outward from the bridge of the nose 304 (e.g., the body of segment 110 has adequate rigidity to not drape down under gravity), and this creates spaces or airgaps 554 and 558 between the interior surfaces of the mask body 100 and the wearer's mouth 310, lower cheek/jawbone area 307, and chin 308. The magnitude of the airgaps 550, 554, and 558 may vary (with size of mask, material used for mask, and size and shape of wearer's face 302) with some embodiments achieving gaps in the range of 0.25 to 1 inch or more.

From a comfort standpoint, the mask 200 uses lightweight materials and is configured so that a majority of this weight is supported the bridge of the nose of a user where the weight is less noticeable. Unlike cloth masks that have no structure or internal support, the use of the nose bridge to bear weight allows the mask to be cantilevered using the center diamond-shaped segment 110 of the body 100 so as to be spaced apart from the user's mouth (as well as the lower portion of their nose and nostrils). This improves airflow, moisture control, and heat buildup (or exhaust from the interior of the mask) as well as being more comfortable to wear due to less mask-to-skin contact. While the mask 200 implements or creates a space between the mouth and nose, the mask 200 is still much smaller than typical shield-type protective gear. The mask 200 leaves the eyes and head free to wear and change glasses/eyewear and to wear headbands, hats, and other headgear without interference. The compact design of the mask 200 gives the user/wearer great freedom of movement including an ability to freely turn their head side-to-side and up-and-down without restriction and without displacing the mask 200.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The present face mask design improves comfort and airflow as compared to conventional masks. It is lighter in weight than face shields but still provides many of the comfort features and visibility of conventional face shields. Further, the new mask remains relatively small in size so that it does not restrict movement or activity as does a face shield. The improved visibility enhances verbal and non-verbal communication with the wearer, and the shape and spacing of the mask from the wearer's face reduce both audio muffling and audio reflection that can interfere with communication with a wearer of a face covering. The mask shape and size not only improve communication but also can be themed with brand-consistent colors and images. The design supports other businesses as well in that photo imaging products can be provided on the mask body while still showing the user's facial expressions. Further, the new design makes it easy for the wearer to accessorize with hats, headbands, and eyewear.

We claim:

1. A face mask, comprising:

a body having a perimeter defined at least partially by an upper edge, a lower edge, a left edge, and a right edge, wherein the body is formed of a flexible material, wherein the body includes a diamond-shaped center segment having a vertical height extending from the upper edge to the lower edge, wherein the vertical height coincides with an overall vertical height of the body, wherein the body further includes an upper left segment, a lower left segment, an upper right segment, and a lower right segment connected to sides of the diamond-shaped center segment, wherein the upper left and the lower left segments extend outward to the left edge at an angle and the upper right and lower right segments extend outward to the right edge at the angle, wherein the upper left segment is spatially separated from the lower left segment, and wherein the upper right segment is spatially separated from the lower right segment; and at least one strap coupled to the left and right edges of the body that is and configured to attach the body to a person's head with the body positioned over the person's nose and mouth.

2. The face mask of claim 1, wherein an outer surface of the body comprises outer surfaces of the diamond-shaped center segment, the upper left segment, the lower left segment, the upper right segment, and the lower right segment, and wherein the outer surface of the body is multi-faceted.

3. The face mask of claim 1, wherein the flexible material is formed of a clear plastic with a thickness in a range of 0.010 to 0.030 inches.

4. The face mask of claim 1, wherein the flexible material comprises clear polypropylene (PP), clear polyphenylene ether (PPE), or clear polyethylene terephthalate (PET).

5. The face mask of claim 1, wherein the diamond-shaped center segment comprises an upper point along and at a center of the upper edge of the body and with a lower point along and at a center of the lower edge of the body.

6. The face mask of claim 1, wherein the angle is in a range of 120 to 150 degrees.

7. The face mask of claim 5, wherein the diamond-shaped center segment is nonplanar with a bend about a line extending between side points of the diamond-shaped center segment and wherein the bend defines a second angle in a range of 120 to 160 degrees, and wherein interior surfaces of the body define an arcuate bowl for use in directing breath exhaled from the person's nose and mouth downward to pass through a gap between the lower edge of the body and the person's face or neck.

8. The face mask of claim 1, wherein a first seam is formed between the upper left segment and the lower left segment and a second seam is formed between the upper right segment and the lower right segment and wherein the first and second seams are provided by an overlapping of material that is press fit together to limit airflow through the body.

9. The face mask of claim 1, further comprising first and second risers attached to and extending along the left and right edges of the body, respectively, and outward a cantilever distance from the upper edge of the body to mate with the at least one strap via outer ends of the first and second risers, wherein the first and second risers have a rigidity and flexibility great enough to lever the left and right edges of the body away from the person's face to create airgaps between the body and the person's face at the left and right edges.

10. The face mask of claim 9, wherein the first and second risers each comprises a cloth edge trimming affixed to the body and an elongate plastic member received within the cloth edge trimming.

11. The face mask of claim 1, wherein the upper and lower edges are U-shaped, whereby the body is configured to be supported on the person's face at five contact points including a first contact point on the bridge of the person's nose, second and third contact points on an upper portion of the person's cheek, and fourth and fifth contact points on the person's face between the person's ears and the person's eyes, and wherein two spaces are configured to be created between the upper edge and the person's face between the second and third contact points and the person's nose to provide inlets for air to be taken into the person's nose and mouth during breathing.

12. A face mask, comprising:

a diamond-shaped center segment having a vertical height extending from upper and lower edges defining a perimeter of the face mask, wherein the vertical height coincides with an overall vertical height of the face mask, and wherein the diamond-shaped center segment is defined by a first planar surface and a second planar surface separated by a central horizontal bend;

an upper left segment extending from a first side of the diamond-shaped center segment at a first downward angle to a first outer edge;

a lower left segment extending from a second side of the diamond-shaped center segment at a second downward angle to a second outer edge;

an upper right segment extending from a third side of the diamond-shaped center segment at the first downward angle to a third outer edge;

a lower right segment extending from a fourth side of the diamond-shaped center segment at the second downward angle to a fourth outer edge;

a first riser attached to and extending along the first and second outer edges to define a left outer edge; and a second riser attached to and extending along the third and fourth outer edges to define a right outer edge, the first and second risers extending outward to outer ends at a cantilever distance from an upper edge of the upper left and right segments, wherein the first and second risers are configured to lever the left and right outer edges away from a face of a person when the person wears the face mask, thereby creating airgaps between the first, second, third, and fourth outer edges and the face of the person, and wherein the diamond-shaped center segment and the upper left, upper right, lower left, and lower right segments are formed of a clear and flexible plastic.

13. The face mask of claim 12, wherein the first and second risers each comprises a cloth edge trimming and an elongate plastic member received within the cloth edge trimming.

14. The face mask of claim 12, further comprising at least one strap coupled to the outer ends of the first and second risers, wherein the at least one strap is configured to attach the face mask to the person's head with the diamond-shaped center segment and the upper left, upper right, lower left, and lower right segments positioned over the person's nose and mouth, wherein the at least one strap is configured to pivot the face mask about the person's nose so as to urge the lower edge of the perimeter outward so as to not be in contact with the person's face.

15. The face mask of claim 12, wherein the clear and flexible plastic has a thickness in a range of 0.010 to 0.030 inches and wherein the clear and flexible plastic comprises clear polypropylene (PP), clear polyphenylene ether (PPE), or clear polyethylene terephthalate (PET).

16. The face mask of claim 12, wherein the first and second downward angles are in a range of 120 to 150 degrees.

17. The face mask of claim 12, wherein the diamond-shaped center segment is nonplanar with a bend about a line extending between corners between the upper left segment and the lower left segment and between the upper right segment and the lower right segment and wherein the bend defines an angle in a range of 120 to 160 degrees, wherein interior surfaces of the face mask define an arcuate bowl for use in directing breath exhaled from the person wearing the face mask downward to pass through a gap between lower edges of the lower left and right segments and the face or neck of the person wearing the face mask.

18. The face mask of claim 12, further comprising a first seam between the upper left segment and the lower left segment and a second seam between the upper right segment and the lower right segment, wherein the first and second seams are formed by a pressure fit between by an overlapping of adjacent pairs of the upper left, upper right, lower left, and lower right segments.

19. A face mask, comprising:

a body with a perimeter defined at least partially by an upper edge, a lower edge, a left edge, and a right edge, wherein the body is formed of a clear and flexible plastic, wherein the body includes a diamond-shaped center segment having a vertical height extending from the upper edge to the lower edge, and wherein the vertical height coincides with an overall vertical height of the body; and at least one strap coupled to the left and right edges of the body and configured to attach the body of the face mask to the head of a person wearing the face mask with the body positioned over the nose and the mouth of the person, wherein the at least one strap is configured to pivot the face mask about the person's nose to urge the lower edge outward to define airgaps between the lower edge and the person's mouth, chin, and lower cheeks, such that the lower edge is not in contact with the person's face at the person's mouth, chin, and lower cheeks, wherein the diamond-shaped center segment is defined by a first planar surface and a second planar surface separated by a central horizontal bend, and wherein the central horizontal bend defines an angle in a range of 120 to 160 degrees, wherein interior surfaces of the body define an arcuate bowl for use in directing breath exhaled from the person's nose and mouth downward to pass through the airgaps.

20. The face mask of claim 19, wherein the upper and lower edges are U-shaped, whereby the body is configured to be supported on the face at five contact points including a first contact point on the bridge of the nose, second and third contact points on an upper portion of cheeks of the person, and fourth and fifth contact points on the face between the person's ears and eyes of the person, and wherein two spaces are configured to be created between the upper edge and the face between the second and third contact points and the nose to provide inlets for air to be taken into the nose and the mouth during breathing by the person.

21. The face mask of claim 19, further comprising first and second risers attached to and extending along the left and right edges of the body and outward a cantilever distance from the upper edge of the body to mate with the at least one strap via outer ends of the first and second risers, wherein the first and second risers are configured to lever left and right edges of the body away from the face to create the airgaps, and wherein the first and second risers each comprises a cloth edge trimming affixed to the body and an elongate plastic member received within the cloth edge trimming.

22. The face mask of claim 19, wherein the clear and flexible plastic of the body has a thickness in a range of 0.010 to 0.030 inches and wherein the clear and flexible plastic is selected from the group consisting of comprises clear polypropylene (PP), clear polyphenylene ether (PPE), or clear polyethylene terephthalate (PET).

23. The face mask of claim 19, wherein sides of the diamond-shaped center segment form a four-sided diamond shape with an upper point along and at a center of the upper edge of the body and with a lower point along and at a center of the lower edge of the body, wherein the body further includes an upper left segment, a lower left segment, an upper right segment, and a lower right segment connected to sides of the center diamond-shaped segment, wherein the upper left and the lower left segments extend outward to the left edge of the body at an angle in range of 120 to 150 degrees and the upper right and lower right segments extend outward to the right edge of the body at the angle in the range of 120 to 150 degrees, and.

24. The face mask of claim 23, wherein a first seam is formed between the upper left segment and the lower left segment and a second seam is formed between the upper right segment and the lower right segment and wherein the first and second seams are provided by an overlapping of material that is press fit together to limit airflow through the body.

25. The face mask of claim 1, wherein the upper left segment is secured to the lower left segment by a first tab and a first slot, and wherein the upper right segment is secured to the lower right segment by a second tab and a second slot.

26. The face mask of claim 25, wherein a first joint is formed by overlapping material from the upper left segment secured to the lower left segment, and wherein a second joint is formed by overlapping material from the upper right segment secured to the lower right segment.

* * * * *